US008358262B2

(12) United States Patent
Degwekar et al.

(10) Patent No.: US 8,358,262 B2
(45) Date of Patent: Jan. 22, 2013

(54) METHOD AND APPARATUS TO SYNCHRONIZE BACKLIGHT INTENSITY CHANGES WITH IMAGE LUMINANCE CHANGES

(75) Inventors: Anil A. Degwekar, Karnataka (IN); David Wyatt, San Jose, CA (US)

(73) Assignee: Intel Corporation, Santa Clara, CA (US)

( * ) Notice: Subject to any disclaimer, the term of this patent is extended or adjusted under 35 U.S.C. 154(b) by 1193 days.

(21) Appl. No.: 10/882,446

(22) Filed: Jun. 30, 2004

(65) Prior Publication Data

US 2006/0001641 A1 Jan. 5, 2006

(51) Int. Cl.
*G09G 3/36* (2006.01)

(52) U.S. Cl. ..... 345/102; 345/97; 345/98; 345/207

(58) Field of Classification Search ..... 345/102, 345/97–98, 207
See application file for complete search history.

(56) References Cited

U.S. PATENT DOCUMENTS

| | | | | |
|---|---|---|---|---|
| 4,958,148 | A | 9/1990 | Olson | |
| 4,958,915 | A * | 9/1990 | Okada et al. | 345/97 |
| 5,197,562 | A * | 3/1993 | Kakinami et al. | 180/169 |
| 5,270,818 | A | 12/1993 | Ottenstein | |
| 5,414,538 | A | 5/1995 | Eschbach | |
| 5,488,434 | A | 1/1996 | Jung | |
| 5,532,719 | A | 7/1996 | Kikinis | |
| 5,745,770 | A | 4/1998 | Thangadurai et al. | |
| 5,748,237 | A | 5/1998 | Ueda et al. | |
| 5,760,760 | A | 6/1998 | Helms | |
| 5,774,112 | A | 6/1998 | Kasson | |
| 5,854,617 | A | 12/1998 | Lee et al. | |
| 5,875,345 | A | 2/1999 | Naito et al. | |
| 5,956,015 | A | 9/1999 | Hino | |
| 6,064,396 | A | 5/2000 | Ouchi et al. | |
| 6,101,272 | A | 8/2000 | Noguchi | |
| 6,111,559 | A | 8/2000 | Motomura et al. | |
| 6,278,436 | B1 | 8/2001 | Hosoi et al. | |
| 6,304,269 | B1 | 10/2001 | Ito | |

(Continued)

FOREIGN PATENT DOCUMENTS

EP 0 883 103 A1 12/1988

(Continued)

OTHER PUBLICATIONS

PCT International Search Report for PCT International Application No. US02/18738, mailed Dec. 5, 2002 (5 pages).

(Continued)

*Primary Examiner* — William Boddie
*Assistant Examiner* — Leonid Shapiro
(74) *Attorney, Agent, or Firm* — Kacvinsky Daisak PLLC

(57) ABSTRACT

An approach for coordinating backlight intensity and image luminance changes. For one aspect, in response to determining that a display-related event has occurred during a vertical frame period indicating a subsequent change associated with at least one of a backlight intensity and a frame buffer palette is to be undertaken, an interrupt is enabled. During subsequent interrupt processing, associated changes to the backlight intensity and the frame buffer palette are applied in a coordinated manner. For a specific implementation, an approach is provided for a graphics controller driver to synchronize response to changes in display backlight, color-space controls, and in the luminance of images, wherein said changes can come from different sources, occur at a different rates, and have different latencies, for the purpose of applying graphics settings responses such that those effects occur at a visually co-incident interval so as to substantially minimize discordant visual artifacts.

12 Claims, 9 Drawing Sheets

U.S. PATENT DOCUMENTS

| | | | | |
|---|---|---|---|---|
| 6,340,975 | B2 | 1/2002 | Marsden et al. | |
| 6,346,937 | B1 | 2/2002 | Sasaki et al. | |
| 6,388,388 | B1 | 5/2002 | Weindorf et al. | |
| 6,466,196 | B1 | 10/2002 | Isogawa et al. | |
| 6,552,749 | B1 | 4/2003 | Jones, Jr. et al. | |
| 6,553,153 | B1 | 4/2003 | Cui | |
| 6,597,339 | B1 * | 7/2003 | Ogawa | 345/102 |
| 6,611,249 | B1 | 8/2003 | Evanicky et al. | |
| 6,618,045 | B1 | 9/2003 | Lin | |
| 6,633,687 | B1 | 10/2003 | Cui | |
| 6,647,501 | B1 | 11/2003 | Ninomiya | |
| 6,664,973 | B1 | 12/2003 | Iwamoto et al. | |
| 6,731,290 | B2 | 5/2004 | Cui | |
| 6,750,837 | B1 * | 6/2004 | Kondoh | 345/97 |
| 6,826,303 | B2 | 11/2004 | D'Souza et al. | |
| 7,154,468 | B2 * | 12/2006 | Linzmeier et al. | 345/102 |
| 2001/0022584 | A1 | 9/2001 | Tsugawa | |
| 2002/0003522 | A1 | 1/2002 | Baba et al. | |
| 2002/0097916 | A1 | 7/2002 | Kaizu | |
| 2002/0154138 | A1 | 10/2002 | Wada et al. | |
| 2002/0196470 | A1 | 12/2002 | Kawamoto et al. | |
| 2003/0001815 | A1 | 1/2003 | Cui | |
| 2003/0011616 | A1 | 1/2003 | D'Souza et al. | |
| 2003/0107577 | A1 * | 6/2003 | Obara et al. | 345/506 |
| 2003/0146919 | A1 * | 8/2003 | Kawashima et al. | 345/609 |
| 2003/0210221 | A1 | 11/2003 | Aleksic | |
| 2003/0210247 | A1 | 11/2003 | Cui et al. | |
| 2004/0156183 | A1 | 8/2004 | Kim | |
| 2004/0174369 | A1 | 9/2004 | Cui | |
| 2004/0233307 | A1 | 11/2004 | Tsujino | |
| 2005/0068289 | A1 | 3/2005 | Diefenbaugh | |
| 2005/0068332 | A1 | 3/2005 | Diefenbaugh | |

FOREIGN PATENT DOCUMENTS

| | | | |
|---|---|---|---|
| EP | 0 888 004 | A2 | 12/1988 |
| EP | 0 883 103 | A1 | 12/1998 |
| EP | 0 888 004 | A2 | 12/1998 |
| EP | 1 111 575 | A1 | 6/2001 |
| EP | 1 251 482 | A2 | 10/2002 |
| JP | 11 213090 | A | 8/1999 |
| JP | 2000330542 | | 11/2000 |
| WO | WO 99/30309 | A1 | 6/1999 |

OTHER PUBLICATIONS

PCT Invitation to Pay Additional Fees for PCT International Application No. US2004/000249, mailed Jun. 7, 2004 (3 pages).

U.S. Appl. No. 10/378,116, filed Feb. 28, 2003, Jones, Jr. et al.

U.S. Appl. No. 11/405,247, filed Apr. 17, 2006, Diefenbaugh et al.

PCT International Search Report for PCT International Application No. PCT/US02/18738, mailed Dec. 5, 2002.

PCT Invitation to Pay Additional Fees for PCT International Application No. PCT/US2004/000249, mailed Jun. 7, 2004 (3 pages).

Jack, K., Video Demystified, A Handbook for theDigital Enggineer, Second Edition, LLH Technology Publishing, Virginia, 1996, pp. 39-61.

European Patent Office, Euopean Search Report for International Application No. EP 02734789.7, 3 pages, Apr. 21, 2004.

Patent Cooperation Treaty's Written Opinion for International Application No. PCT/US02/18738, dated Jul. 10, 2003, 6 pages.

PCT International Search Report for PCT International Application No. PCT/US2004/030573, mailed Feb. 2, 2005, 4 pages.

* cited by examiner

METHOD AND APPARATUS TO SYNCHRONIZE BACKLIGHT INTENSITY CHANGES WITH IMAGE LUMINANCE CHANGES

CROSS-REFERENCE TO RELATED APPLICATION

The present application is related to co pending U.S. patent application Ser. No. 10/367,070 entitled, "Real-Time Dynamic Design of Liquid Crystal Display (LCD) Panel Power Management Through Brightness Control", filed Feb. 14, 2003, co pending U.S. patent application Ser. No. 10/663,316, entitled "Automatic Image Luminance Control with Backlight Adjustment",filed Sep. 15, 2003, co pending U.S. patent application Ser. No. 09/896,341 entitled, "Method and Apparatus for Enabling Power Management of a Flat Panel Display", filed Jun. 28, 2001 and co pending U.S. patent application Ser. No. 10/745,239 entitled "Method and Apparatus for Characterizing and/or Predicting Display Backlight Response Latency", filed Dec. 22, 2003, all assigned to the assignee of the present invention.

BACKGROUND

An embodiment of the present invention relates to the field of display backlight control and, more particularly, to coordinating changes in backlight intensity with image luminance changes.

Computing devices that can be easily moved from place to place often include an alternative power source, such as a battery, to facilitate mobility. Examples of such devices include laptop or notebook computers, personal digital assistants (PDAs), wireless phones, etc.

Where a battery or another limited power source is used, it is typically desirable to provide for efficient power usage to enable a longer operating period. Various measures may be taken to extend battery life, such as, for example, shutting down components that are not in use.

In many computing devices the display is responsible for a relatively large percentage of overall power consumption. In laptop computers, for example, the display may account for 30% of the power consumed. In order to reduce display power consumption, some computing systems may reduce the panel backlighting when the system is being powered by a battery instead of an AC power source. Reducing the panel backlighting according to one or more conventional approaches may be perceived as a reduction in display quality, particularly in brighter ambient environments.

BRIEF DESCRIPTION OF THE DRAWINGS

The present invention is illustrated by way of example and not limitation in the figures of the accompanying drawings in which like references indicate similar elements, and in which.

DETAILED DESCRIPTION

Figure 4:
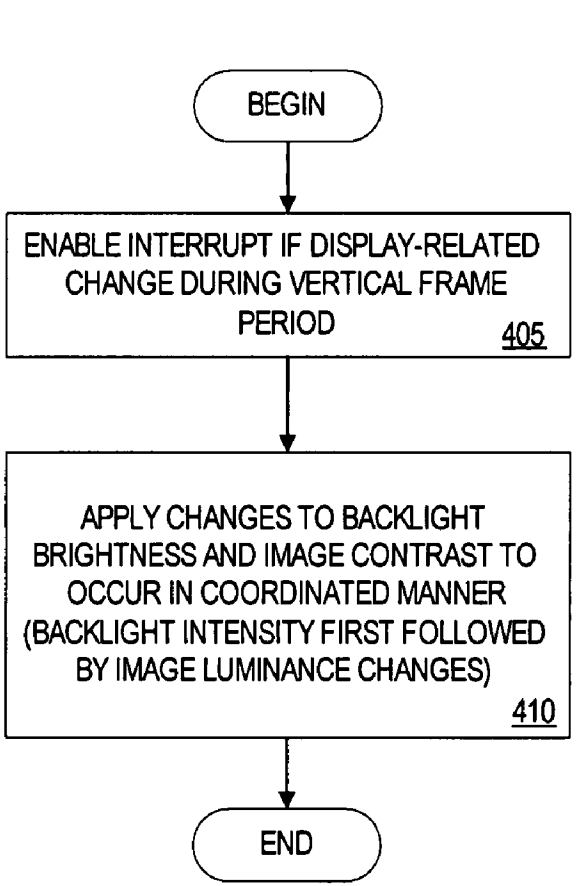
FIG. 4 is a flow diagram showing a method of one embodiment for adjusting characteristics of a display.

A method and apparatus for coordinating backlight intensity changes with image luminance changes are described. In the following description, particular software modules, hardware modules, components, systems, etc. are described for purposes of illustration. It will be appreciated, however, that other embodiments are applicable to other types of software modules, hardware modules components, and/or systems, for example.

References to "one embodiment," "an embodiment," "example embodiment," "various embodiments," etc., indicate that the embodiment(s) of the invention so described may include a particular feature, structure, or characteristic, but not every embodiment necessarily includes the particular feature, structure, or characteristic. Further, repeated use of the phrase "in one embodiment" does not necessarily refer to the same embodiment, although it may.

Placement-related terms in the description that follows such as, for example, above, below, behind, etc. may be used to indicate relative placement in the context of the figures as shown. It will be appreciated that different orientations of the various components of the invention may result in a different relative placement of components to each other.

For one embodiment, an electronic system, such as the computing system of FIG. 2, may provide for dynamic adjustment of both display backlight and image contrast/brightness/gamma (or luminance) in a coordinated manner. The dynamic adjustments to display backlight and image luminance according to some embodiments may be coordinated such that the end-user visual experience is not significantly impacted and/or visual artifacts that may be caused by a lack of such coordination are substantially avoided.

For example, for one embodiment, in response to determining that there has been a display-related event during a vertical frame period indicating that an associated change to at least one of a backlight intensity and an image luminance setting is to be undertaken, an interrupt is enabled. Then, during subsequent interrupt processing, corresponding changes to the backlight intensity and the image luminance are applied in a coordinated manner.

Further details of these and other embodiments are provided in the description that follows.

Embodiments of the invention may be implemented in one or a combination of hardware, firmware, and software. Embodiments of the invention may also be implemented in whole or in part as instructions stored on a machine-readable medium, which may be read and executed by at least one processor to perform the operations described herein. A machine-readable medium may include any mechanism for storing or transmitting information in a form readable by a machine (e.g., a computer). For example, a machine-readable medium may include read only memory (ROM); random access memory (RAM); magnetic disk storage media; optical storage media; flash memory devices; electrical, optical, acoustical or other form of propagated signals (e.g., carrier waves, infrared signals, digital signals, etc.), and others.

Figure 1:
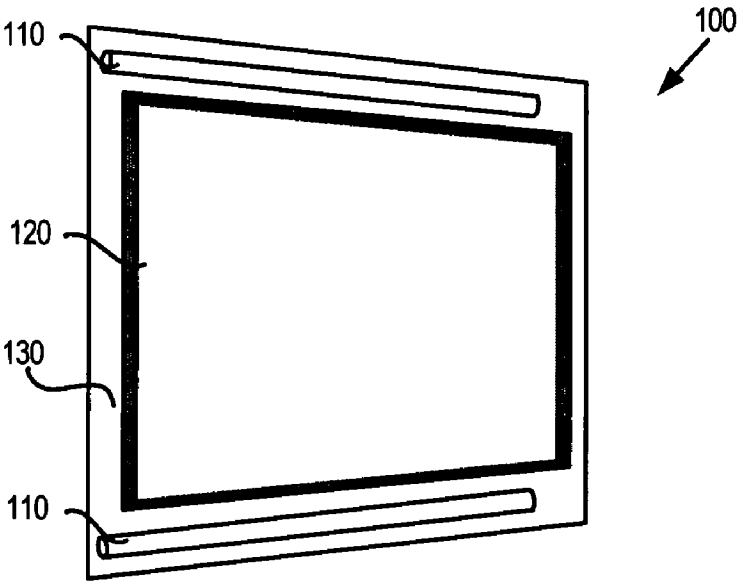
FIG. 1 is an isometric view of a panel display that may be used for some embodiments.

FIG. 1 shows an isometric view of a panel display 100 that may be used for one embodiment. The panel display 100 may include one or more backlights 110, a panel 120, and a light spreader 130. The backlight(s) 110 may include, for example, a cold cathode fluorescent tube. For other embodiments, the backlight(s) 110 may include one or more Electroluminescence Panels (ELP) or Incandescent Lamps, or light emitting diodes (LEDs), such as, for example, white LEDs, which may be driven in a conventional manner. The backlight(s) may be located behind and above/below the panel 120 to provide illumination to the rear of the panel 120.

The panel 120 may include, for example, a liquid crystal display (LCD) panel that is arranged to display an image that is illuminated by the backlight(s) 110. Other types of backlit display technologies may also be used for various embodiments.

The light spreader 130 may be arranged substantially behind the backlight(s) 110, and may also extend above/below the backlight(s) 110 to direct their light to the rear of the panel 120. The light spreader may reflect and/or diffuse light from the backlight(s) 110 to illuminate the panel 120 substantially uniformly along its surface. Other embodiments, using, for example white LEDs, may not use a light spreader, or may be incorporated within a light box, or use an encapsulated lens for directing radiated light energy.

Figure 2A:
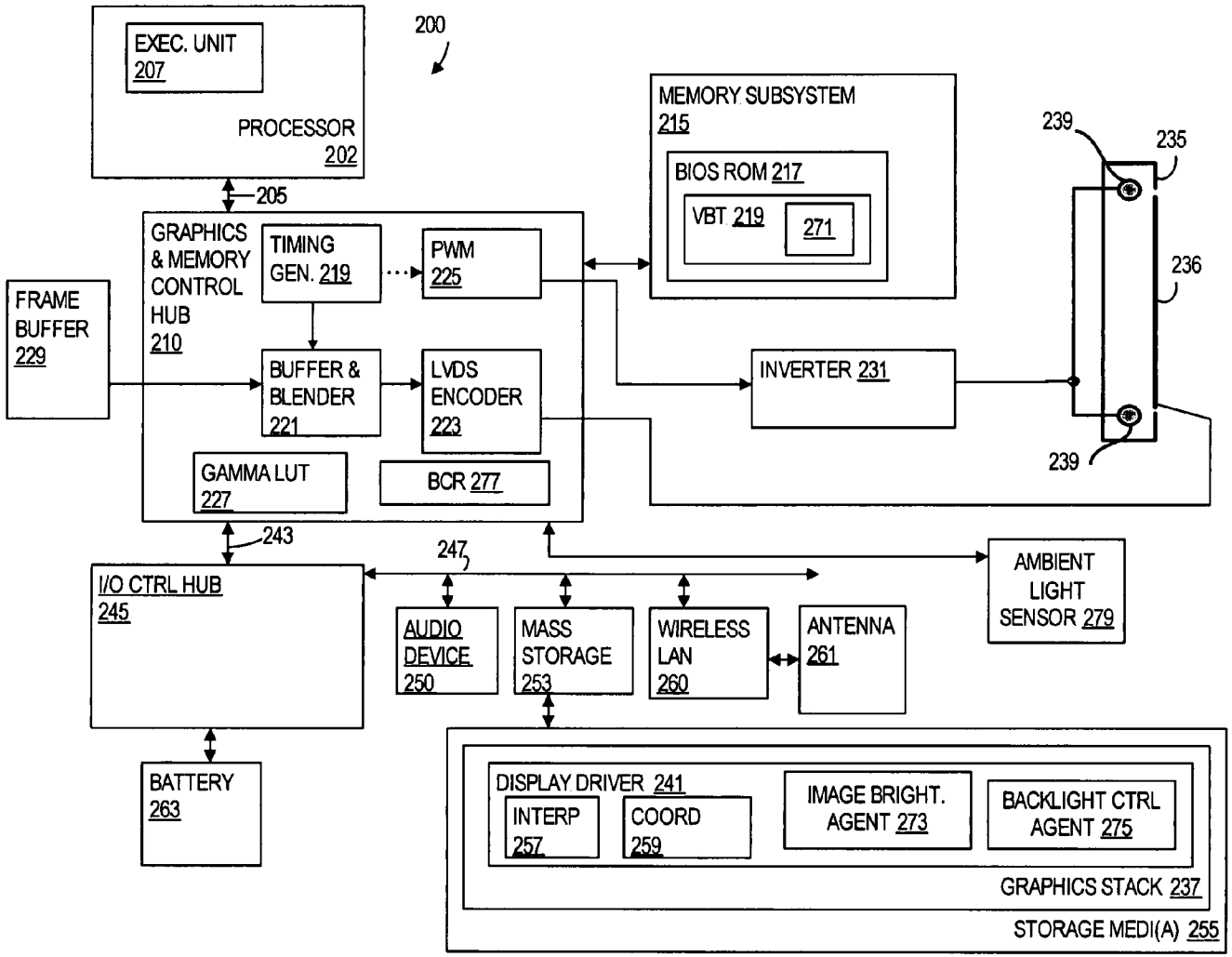
FIGS. 2A and 2B are block diagrams of exemplary computing systems in which the approaches of one or more embodiments for coordinating dynamic adjustments to backlight and image luminance may be advantageously implemented.

FIG. 2A is a block diagram of an exemplary computing system 200 that may advantageously implement the approaches of one or more embodiments for coordinating backlight brightness and image luminance adjustments. While the example system of FIG. 2A is a laptop computer system, it will be appreciated that the image adaptation techniques described herein may be applied to many different types of systems with an associated display device. Examples of such systems include, but are not limited to, personal digital assistants (PDAs), palm top computers, notebook computers, tablet computers, desktop computers using flat panel displays, wireless phones, kiosk displays, etc.

The computing system 200 includes a processor 202 coupled to a bus 205. The processor 202 includes at least one execution unit 207 to execute instructions that may be stored in one or more storage devices in the system 200 or that are otherwise accessible by the system 200.

For one embodiment, the processor 202 may be a processor from the Pentium® family of processors such as, for example, a processor from the Pentium-M family of processors available from Intel Corporation of Santa Clara, Calif. Alternatively, a different type of processor and/or a processor from a different source and/or using a different architecture may be used instead or in addition to the above-described processor. Other types of processors that may be used for various embodiments include, for example, a digital signal processor, an embedded processor or a graphics processor.

A graphics and memory control hub (or GMCH) 210 is also coupled to the bus 205. The graphics and memory control hub 210 may include a memory controller (not shown) that is coupled to a memory subsystem 215. The memory subsystem 215 is provided to store data and instructions to be executed by the processor 202 or any other device included within the electronic system 200. For one embodiment, the memory subsystem 215 may include dynamic random access memory (DRAM). The memory subsystem 215 may, however, be implemented using other types of memory in addition to or in place of DRAM. For some embodiments, the memory subsystem 215 also includes BIOS (Basic Input/Output System) ROM 217 including a Video BIOS Table (VBT) 219. Additional and/or different devices not shown in FIG. 2A may also be included within the memory subsystem 215.

Also coupled to the graphics and memory control hub 210 over a bus 243 is an input/output (I/O) control hub 245 or other type of I/O controller, which provides an interface to input/output devices. The input/output controller 245 may be coupled to, for example, a Peripheral Component Interconnect (PCI™) or PCI Express™ bus 247 adhering to a PCI Specification such as Revision 2.1 (PCI) or 1.0a (PCI Express) promulgated by the PCI Special Interest Group of Portland, Oreg. For other embodiments one or more different types of buses such as, for example, an Accelerated Graphics Port (AGP) bus according to the AGP Specification, Revision 3.0 or another version, may additionally or alternatively be coupled to the input/output controller 245 or the bus 247 may be a different type of bus.

Coupled to the input/output bus 247 for one embodiment are an audio device 250 and a mass storage device 253, such as, for example, a disk drive, a compact disc (CD) drive, and/or a network device to enable the electronic system 200 to access a mass storage device over a network. An associated storage medium or media 255 is coupled to the mass storage device 253 to provide for storage of software and/or other information to be accessed by the system 200.

In addition to an operating system (not shown) and other system and/or application software, for example, the storage medium 255 may store a graphics stack 237 to provide graphics capabilities as described in more detail below. A display driver 241 may be included in the graphics stack 237. For one embodiment, the display driver 241 includes or works in cooperation with at least an interpolation module 257 and a coordination module 259 described in more detail below. Other modules may also be included for other embodiments.

The system 200 may also include a wireless local area network (LAN) module 260 and/or an antenna 261 to provide for wireless communications and an input device 262 such as a keyboard, a cursor control device, a stylus, etc to receive user input for the system 200. A battery or other alternative power source adapter 263 may also be provided to enable the system 200 to be powered other than by a conventional alternating current (AC) power source. Alternatively, a battery connected to the adapter 263 may provide the primary power source for the system 200 for some embodiments.

With continuing reference to FIG. 2A, the graphics and memory control hub 210 may further include graphics control capabilities. As part of the graphics control capabilities, a timing generator 219, a buffer and blender 221, an encoder 223, a gamma look-up table (LUT) 227 or other mechanisms through which adjustments of image luminance may be made may be provided. Also associated with LCD display brightness are a pulse width modulator (PWM) 225, a high voltage inverter 231, and a cold cathode fluorescent lamp (CCFL) backlight 239, however other embodiments may include alternate methods for providing backlight, including but not limited to, Electroluminescence Panel (ELP), Incandescent Light, or Light Emitting Diode (LED). Also some embodiments may not require a PWM or high-voltage inverter such as in Incandescent Light backlighting using direct drive DC current, or may include a PWM and no inverter, such as in LED backlighting. Also associated with graphics control capabilities are a frame buffer 229, and a display 235, which may be implemented in a similar manner to the display 100 of FIG. 1 including a panel 236, the graphics stack 237 including the display driver 241, and other modules for some embodiments.

Figure 2B:
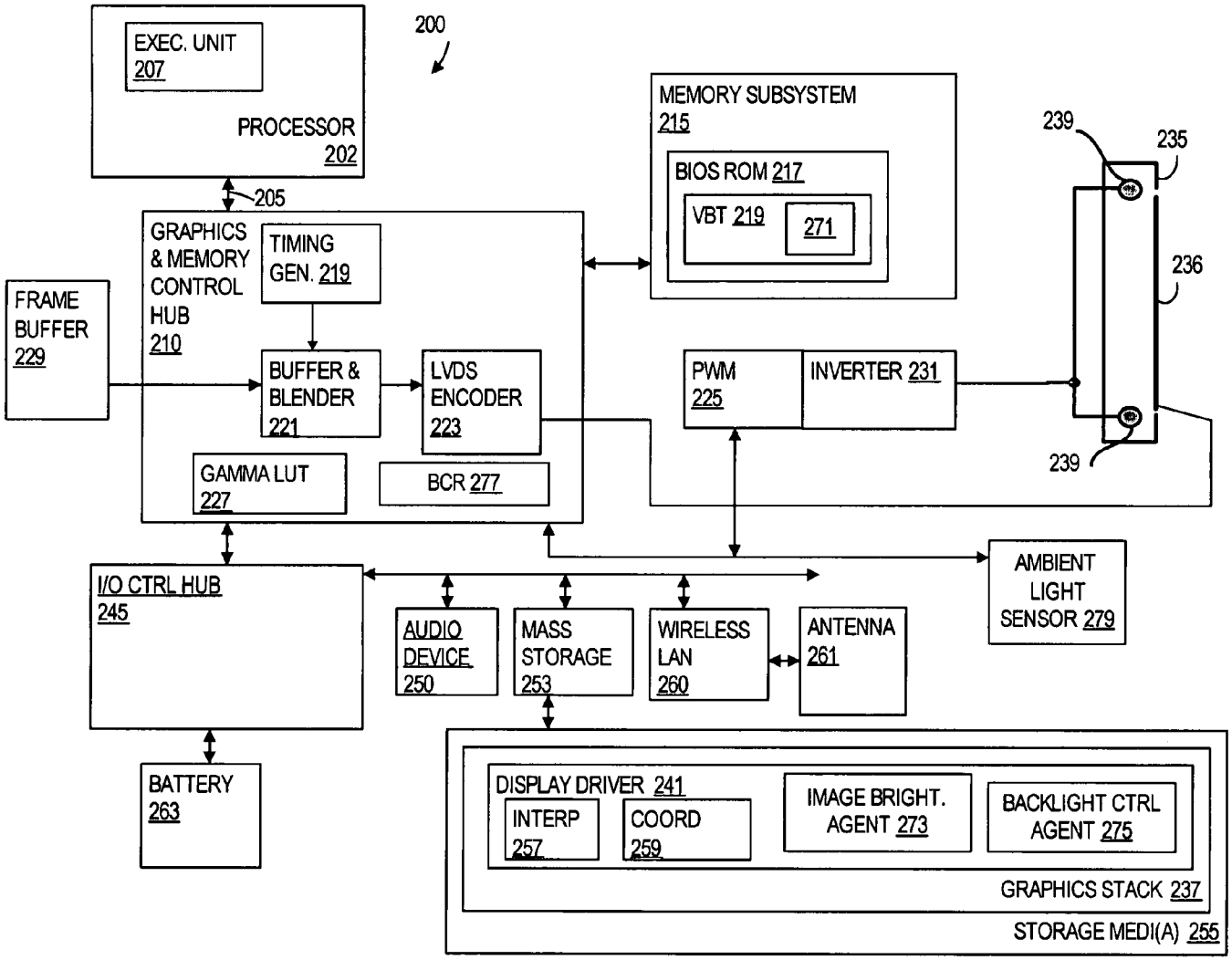

In various implementations, two or more of elements discussed above may be integrated within a single device or in a different manner for other embodiments. For example, as shown in FIG. 2B, the pulse width modulator 225 may be integrated with the graphics controller in a standalone component or integrated with the inverter 231. For such embodiments, the PWM 225/inverter 231 may be driven by software and coupled to either the graphics and memory control hub 210 or the I/O control hub 240. Further, the functionality of one or more of the graphics-related elements may be implemented in hardware, software, or some combination of hardware and software.

The frame buffer 229, timing generator 219, buffer and blender 221, and encoder 223 may cooperate to drive the panel 236 of the panel display 235. The frame buffer 229 may include a memory (not shown) and may be arranged to store one or more frames of graphics data to be displayed by the panel display 235.

The timing generator 219 may be arranged to generate a refresh signal to control the refresh rate (e.g. frequency of refresh) of the panel 236. The timing generator 219 may produce the refresh signal in response to a control signal from the display driver 241. In some implementations, the refresh signal produced by the timing generator 219 may cause the panel 236 to be refreshed at a reference refresh rate (e.g. 60 Hz) during typical (e.g. non-power saving) operation. During power saving operation, the timing generator 219 may lower refresh rates for panel display 110 (e.g. to 50 Hz, 40 Hz, 30 Hz, etc.). Associated with the refresh rate is a vertical blanking interval (VBI).

The buffer and blender 221 may read graphics data (e.g. pixels) from the frame buffer 229 in graphics memory at the refresh rate specified by the refresh signal from the timing generator 219. The buffer and blender 221 may blend this graphics data (e.g. display planes, sprites, cursor and overlay) and may also gamma correct the graphic data. The buffer and blender 221 also may output the blended display data at the refresh rate. In one implementation, the buffer and blender 221 may include a first-in first-out (FIFO) buffer to store the graphics data before transmission to the encoder 223.

The encoder 223 may encode the graphics data output by the buffer and blender 221 for display on the panel 236. Where the panel 236 is an analog display, the encoder 223 may use a low voltage differential signaling (LVDS) scheme to drive the panel 236. For other implementations, if the panel 236 is a digital display, the encoder 223 may use another encoding scheme that is suitable for this type of display. Because the encoder 223 may receive data at the rate output by the buffer and blender 221, the encoder may refresh the panel 236 at the refresh rate specified by the refresh signal from the timing generator 219.

The PWM 225 and inverter 231 may cooperate to drive the backlight(s) 239 in the panel 235. The PWM may be arranged to output a PWM signal that has a modulation frequency and a duty cycle. For some implementations, the duty cycle setting of the PWM 225 may be varied by the display driver 241, or in another manner, to dim the light output by the backlight (s) 239. The PWM 225 may be arranged to output the PWM signal to the inverter 231 at a reference modulation frequency and duty cycle during typical (e.g. non-power saving) operation.

For one implementation, the PWM 225 may receive a timing signal from the timing generator 219 and may derive its base frequency from this timing signal, upon which the output duty cycle is modulated according to a PWM interface setting value. Such an implementation is illustrated by the dashed line between the timing generator 219 and the PWM 225. For other implementations, however, the PWM 225 may include its own, separate timing generator for use in deriving its reference clock. In either case, the modulation frequency of PWM 225 may be adjusted (e.g. lowered during a power saving mode) by the display driver 241 or another module.

The inverter 231 may be arranged to receive the PWM signal at the modulation frequency from the PWM 225 and to drive the backlight(s) 239 based on the modulation frequency of the PWM signal. The inverter 231 may produce an output whose "backlight frequency" is a multiple of the modulation frequency of the received PWM signal from the PWM 225. For one implementation, the backlight frequency of the output of the inverter 231 may be substantially the same frequency as the PWM signal. For other implementations, the inverter 231 may be arranged to effect a higher multiple of the modulation frequency, producing an output signal with a backlight frequency that may vary over a larger range.

For one embodiment the gamma LUT 227 may be provided to adjust the sub-pixel colors prior to being sent to the display device. In an alternate embodiment a separate luminance adjustment stage (e.g. using HSI or YUV color-space conversion and adjustment) may be included prior to or after a stage in which adjustments to the gamma LUT are performed. As such, color luminance or contrast may be adjusted via modification of the color look-up table (gamma LUT) 227 or through a discrete luminance adjustment stage. Other approaches to adjusting image luminance are within the scope of various embodiments.

Figure 3:
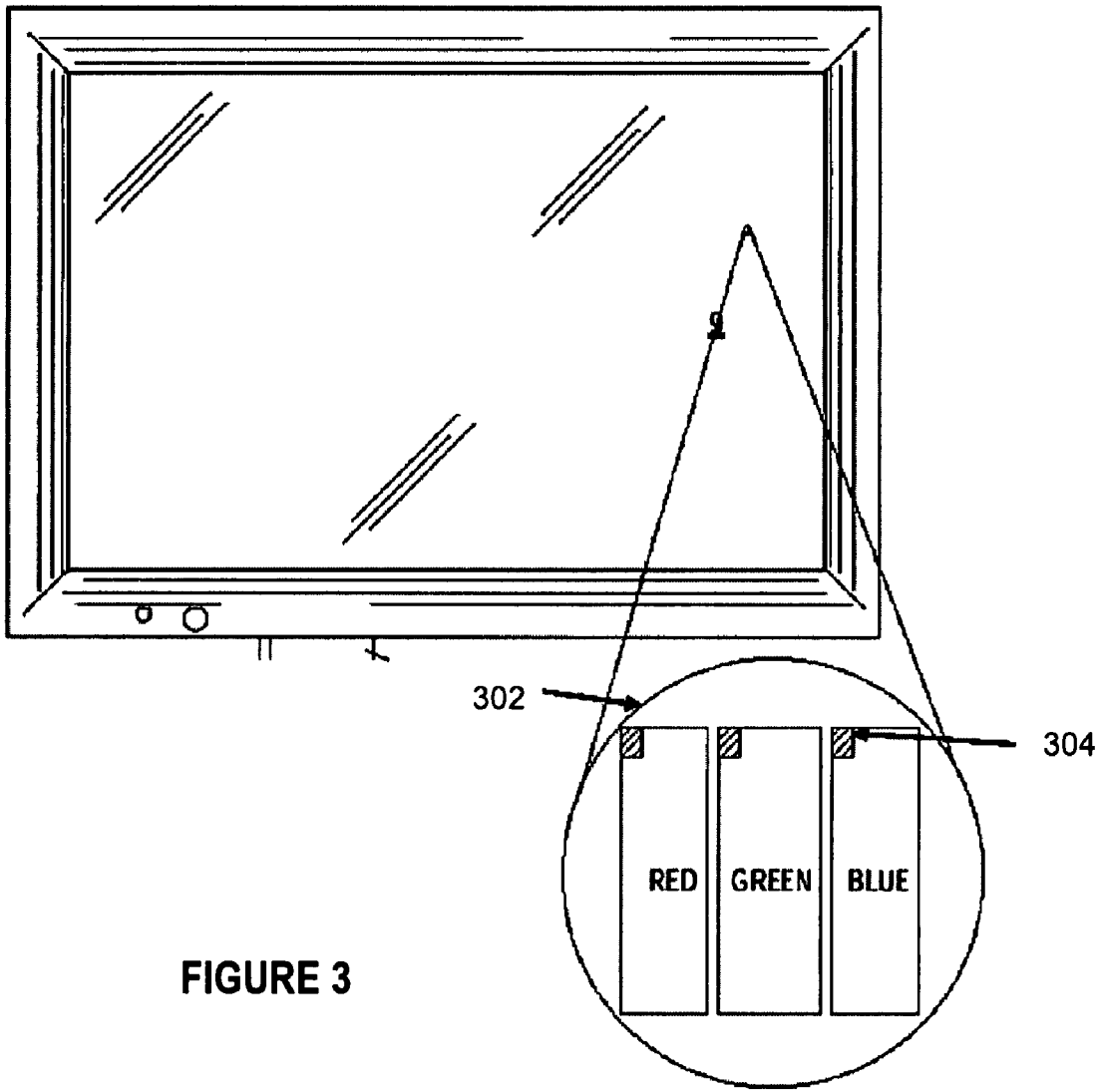
FIG. 3 is an illustration of a display and an associated group of pixels for one embodiment.

FIG. 3 illustrates a group of pixels within a flat-panel monitor screen such as the display 100 of FIG. 1. For one embodiment, the pixels are formed using thin film transistor (TFT) technology, and each pixel is composed of three sub-pixels that, when enabled, cause a red, green and blue (RGB) color to be displayed. Each sub-pixel is controlled by a TFT (e.g. 304). A TFT enables light from the display backlight to pass through a sub-pixel, thereby illuminating the sub-pixel to a particular color. Each sub-pixel color may vary according to a combination of bits representing the sub-pixel. The number of bits representing a sub-pixel determines the number of colors, or color depth, that may be displayed by a sub-pixel. Sub-pixel coloring is known in the art and any appropriate technique for providing sub-pixel coloring, including those according to a different color-coding scheme, may be used.

A brighter or dimmer luminance of color (effecting different levels of image contrast) being displayed by a pixel may be achieved by scaling the value representing each sub-pixel color within the pixel. The particular values used to represent different colors depend upon the color-coding scheme, or color space, used by the particular display device. By modifying color luminance of the sub-pixels (by scaling the values representing sub-pixel colors), the perceived brightness of the display image may be modified on a pixel-by-pixel basis.

It will be appreciated that systems according to various embodiments may not include all the elements described in reference to FIGS. 2A and/or 2B and/or may include elements not shown in FIG. 2A or 2B. For example, for some embodiments, an ambient light sensor (ALS) 279 and associated circuitry and/or software may be included to assist in determining when to adjust backlight brightness and/or display contrast. The ALS 279 may be coupled to, for example, a graphics bus or a system management bus coupled to the graphics and memory control hub 210. For some embodiments, the ALS 279 does not directly control backlight adjustments, but rather readings from the ALS 279 may be used with a backlight control algorithm to effect changes to the backlight.

For one embodiment, as mentioned above, the brightness of the backlight(s) 239 may be dynamically adjusted to provide for more efficient power usage, to adjust brightness according to ambient conditions and/or to compensate for image intensity changes. Color intensity values for the pixels may also be dynamically adjusted to change display contrast based on ambient conditions and/or backlight intensity. By adjusting the backlight and contrast together, it may be possible for some embodiments, to improve power efficiency while still providing a substantially similar perceived display brightness.

Issues may arise, however, if the adjustments to the backlight and image luminance are not coordinated properly as discussed above. For example, a portion of an image may be displayed with one brightness and contrast level while the brightness or contrast level of another portion of the image may be different.

More particularly, while changes to the gamma LUT 227 and resultant changes to the image luminance are effectively instantaneous (e.g. the new gamma-range color/luminance/contrasts may take effect immediately, on the next vertical scanline, or on the next vertical frame after the change is made), adjustment of backlight brightness is not typically immediate. Apart from the communication overhead through the PWM 225 and inverter 231, for example, the PWM 225 takes at least an additional pulse in order to reach a new duty-cycle associated with a target backlight brightness, and the inverter 231 may take several pulses to stabilize at a new setting. Further, where fluorescent illumination is used, for example, there may be a latency of hundreds to thousands of milliseconds for some exemplary backlights to reach a target perceptual brightness level (e.g. due to the time it takes gas-electric discharge to cause the fluorescent lining of the lamp to illuminate to the target level).

To substantially avoid associated visually disturbing artifacts, for one embodiment changes to the backlight brightness and gamma table (resulting in a change in image luminance) are coordinated to occur close in time to each other.

Referring to FIG. 4, for example, for one embodiment, to synchronize backlight intensity and image luminance changes, at block 405, in response to determining that a display-related change associated with at least one of a backlight intensity and an image luminance has occurred during a vertical frame period, an interrupt is enabled. At block 410, changes to the backlight intensity and image luminance are applied in a coordinated manner by first initiating changes to the backlight intensity and then, after a predetermined delay based on the time it takes for the backlight intensity to reach a target level, changes to the image luminance are applied.

Figure 5:
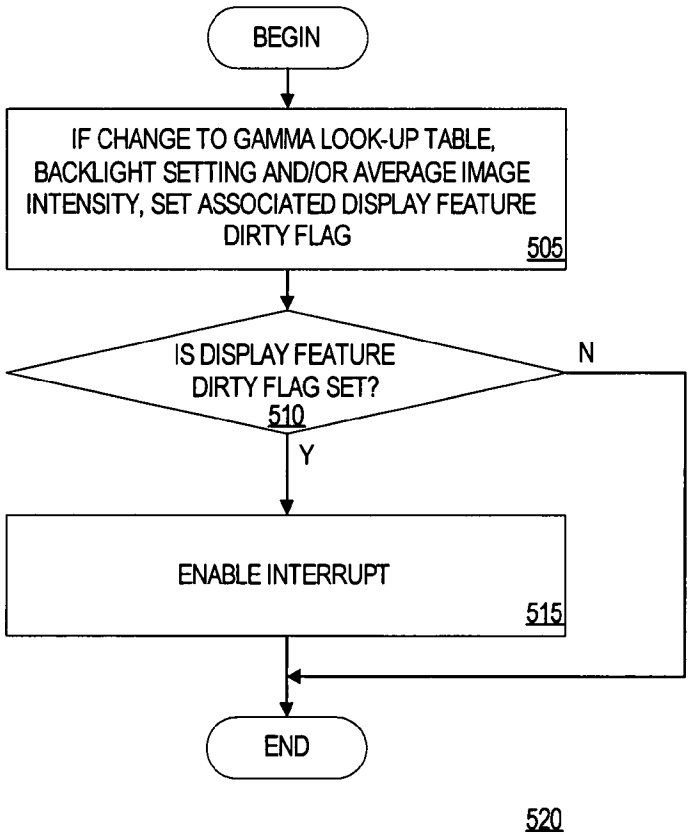
FIG. 5 is a flow diagram showing a method of one embodiment for identifying that display feature changes are to occur.

FIG. 5 is a flow diagram showing a specific approach of one embodiment for indicating that there has been a display-related change during a vertical frame period, and enabling an associated interrupt. In describing the methods of FIG. 5-8, reference is made to FIG. 2A and/or 2B for purposes of illustration. For example, software code that performs similar actions to those described in reference to FIGS. 5-8 may be provided as part of a coordination module 259 in the display driver. It will be appreciated however, that the specific hardware and/or software modules of FIG. 2A and/or 2B are not necessarily required to implement the method of various embodiments. Further, it will be appreciated that not all of the actions described in reference to FIGS. 5-8 are required for all embodiments, and/or for some embodiments, additional actions may be included.

With continuing reference to FIG. 5, at block 505, if there is a change to the gamma look-up table, backlight setting and/or average image intensity, an associated dirty flag may be set.

The gamma look-up table (or screen color palette) may be changed by, for example, an application, user or an operating system. A request for such a change may be received by a display driver such as the display driver 241 of FIG. 2A or 2B. The driver may then store the user-desired gamma (where the user may be an application, operating system or user, for example) and set a gamma dirty flag.

The backlight setting may be changed by a user via a hotkey, a user interface control or other input mechanism, or by a BIOS, operating system or other routine that changes backlight based on a change in power source, ambient light or system activity, for example. The target backlight brightness and/or image luminance may be determined based on the ambient light level detected by the ambient light sensor 279, for example. In a bright environment, for example, maximum backlight intensity and/or increased color brightness may be used to provide an image that is more easily viewable. In a dimly lit room, however, decreased backlight intensity and/or color brightness may be used to provide an image that is perceived to be of substantially the same quality. Other factors may also or alternatively be considered to determine when changes to the backlight brightness and/or image luminance are to be initiated.

In response to a requested change to a backlight setting, for one embodiment, a display driver such as the display driver 241 may receive an interrupt, store the desired backlight value and set a backlight dirty flag.

A change in average image intensity may be detected as display hardware, such as the graphics and memory control hub 210, calculates a histogram for a particular frame or image indicating the number of pixels associated with each of several luminance values. An example of such a histogram and the manner in which it may be determined for one embodiment is described in more detail in the above-referenced co pending patent application Ser. No. 09/896,341 entitled, "Method and Apparatus for Enabling Power Management of a Flat Panel Display", filed Jun. 28, 2001. Other approaches for determining average image intensity are within the scope of various embodiments.

For one embodiment, such a histogram is calculated for each frame, and an associated average image intensity is determined based on the histogram. The average image intensity may then be compared to an average image intensity for a previous frame to determine whether there has been a change. For some embodiments, the average image intensity change versus the intensity for which the current settings were determined must be greater than or equal to a given trigger point in order to cause a resulting change in backlight and/or image luminance values. For some embodiments, this trigger point may be programmable by the display driver 241 or other software, for example.

In response to a change in average image intensity that is greater than or equal to the trigger point, for example, display hardware, such as the graphics and memory control hub 210 may raise a histogram interrupt. Display hardware or software, such as the display driver 241 may then set a histogram dirty flag.

Still referring to FIG. 5, at decision block 510, it is determined whether a dirty flag is set. In the example embodiment described above, if any of the gamma, backlight and/or histogram dirty flags is set, then at block 515, an interrupt is enabled.

Figure 6:
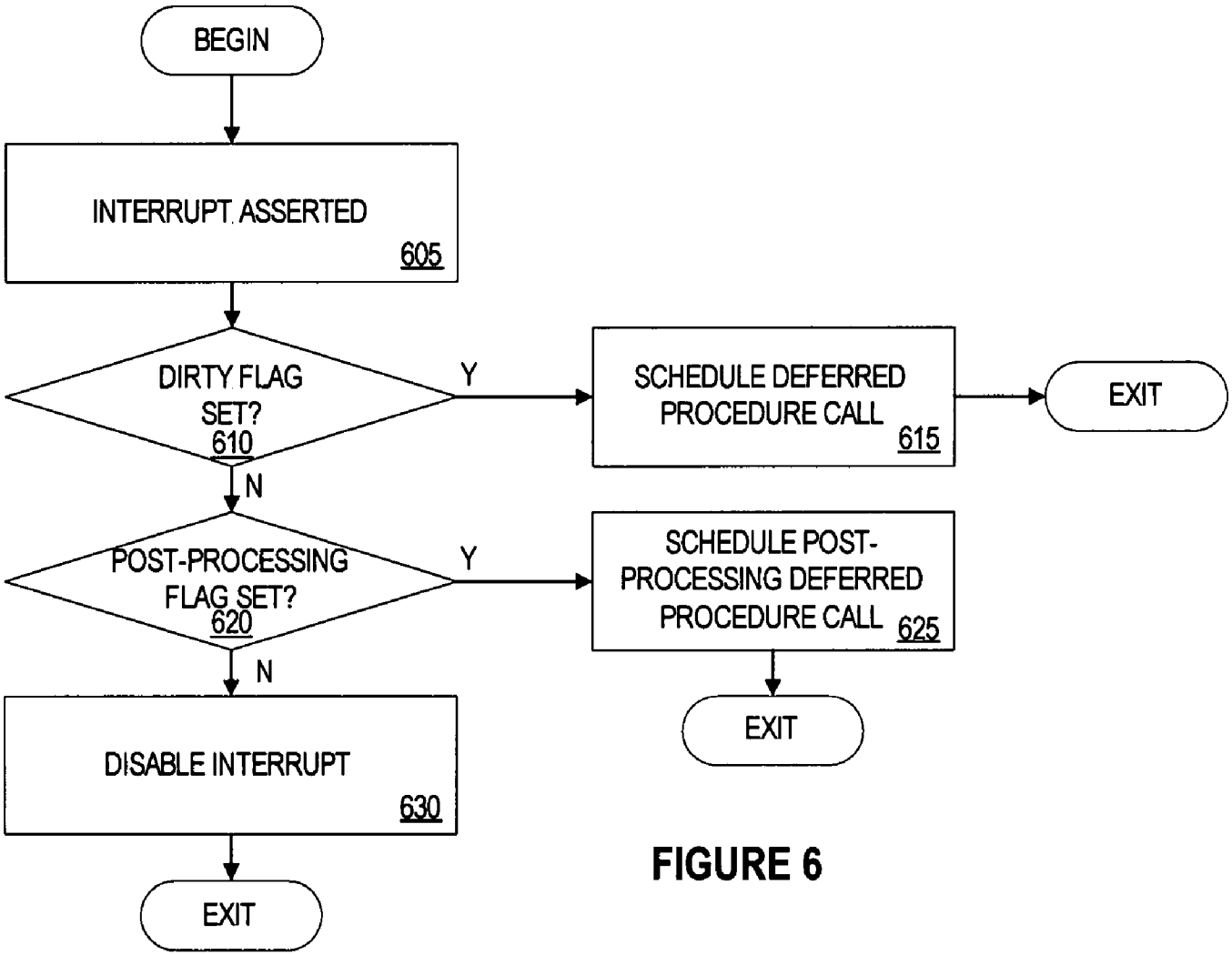
FIG. 6 is a flow diagram showing a method of one embodiment for interrupt processing to process display changes.
Figure 10:
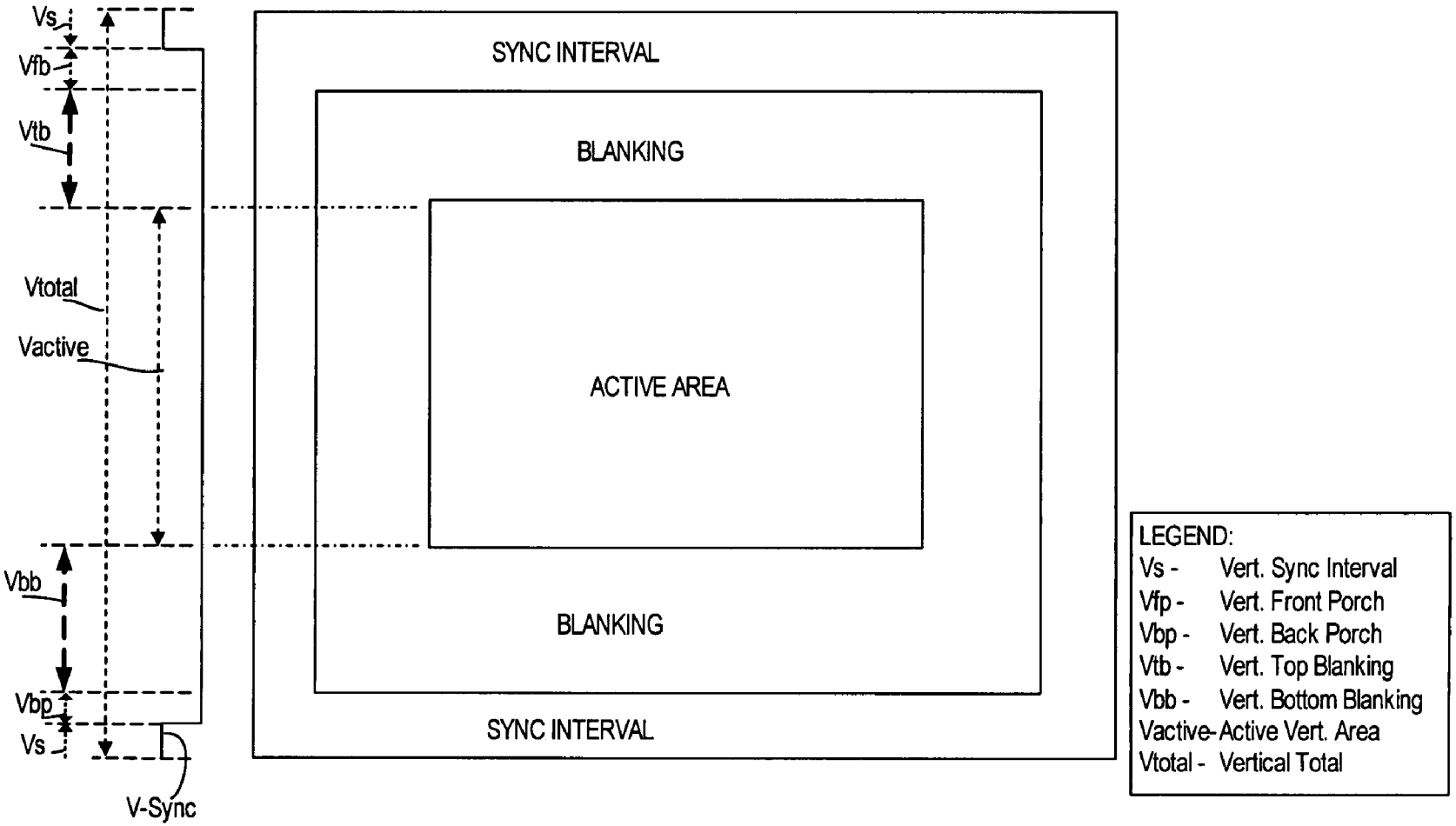
FIG. 10 is a diagram illustrating exemplary timing of vertical scanlines.

FIG. 6 is a flow diagram showing an approach of one embodiment for interrupt processing if the interrupt is enabled. At block 605, the interrupt is asserted. For one embodiment, the interrupt is a vertical sync interrupt. For other embodiments, the interrupt may be a different type of interrupt or may occur other than in the vertical sync interval, such as at or within the vertical blank, so long as the interrupt occurs prior to the next vertical refresh. FIG. 10 illustrates an example of these various timings. By applying changes, and, in particular, changes affecting image luminance, in the vertical sync or vertical blank timeframe, disturbing display artifacts that may result from applying such changes at a different time, may be substantially avoided.

At decision block 610, it is determined whether a dirty flag is set. For the embodiment described above, this action determines whether any of the histogram, backlight or gamma dirty flags have been set. If so, then at block 615, a deferred procedure call is scheduled to provide additional processing.

Figure 7:
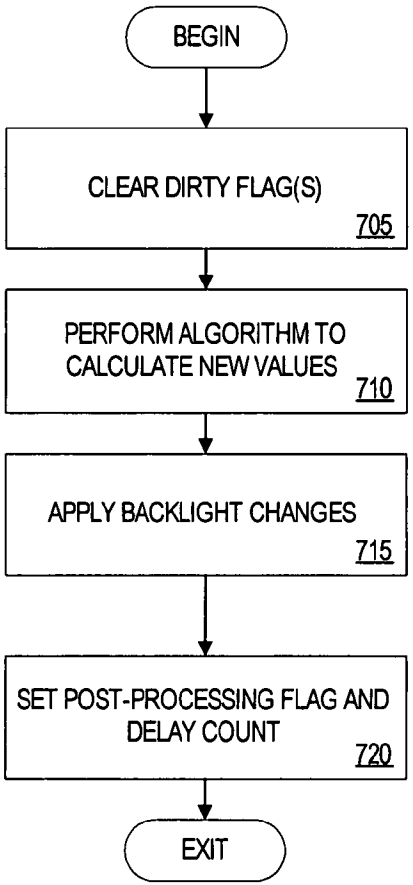
FIG. 7 is a flow diagram showing a method of one embodiment for a deferred procedure call that may be used to effect display feature changes.

FIG. 7 is a flow diagram illustrating actions that may be taken in a deferred procedure call of one embodiment. At block 705, the dirty flag(s) is cleared and at block 710, an algorithm is performed to calculate the new display-related values as a result of the detected change(s).

For one embodiment, in order to maintain a substantially consistent user-perceived display brightness level, changes in backlight may be applied with corresponding changes in image luminance. Some exemplary approaches for doing so are described in one or more of the co pending related patent applications referenced above. In particular, U.S. patent application Ser. No. 09/896,341 entitled, "Method and Apparatus for Enabling Power Management of a Flat Panel Display", filed Jun. 28, 2001 describes how to determine new luminance values based on changes to the backlight settings and vice versa. The approach described therein may be used to perform the action at block 710 for some embodiments. Other approaches for determining the display-related changes to be applied may be used for various embodiments.

At block 715, the determined changes to the backlight, if applicable are applied. To adjust the backlight brightness for one embodiment, the backlight control agent 275 may write a value representing a scaling factor to a backlight control register (BCR) 277. The value stored in the backlight control register may then be combined with one or more other parameters to determine a duty cycle for the PWM 225 to control backlight intensity.

Further details of the manner in which the backlight and/or image luminance may be adjusted for some embodiments may be provided in one or more of the above-referenced co-pending patent applications.

Changes to the backlight are applied first because they are associated with a given latency as described above. At block 720, a post-processing flag may then be set indicating that further actions are to be taken in, for example, a post-processing deferred procedure call.

A delay count may also be initiated at block 720. The delay count is based on the latency associated with changing the backlight from the prior intensity level to the target intensity level identified at block 710 (where it is determined that such change is to be made). The delay associated with changing the backlight intensity from a first level to a second target level may be determined according to one or more of the approaches described in co pending U.S. patent application Ser. No. 10/745,239 entitled "Method and Apparatus for Characterizing and/or Predicting Display Backlight Response Latency", filed Dec. 22, 2003.

Figure 9:
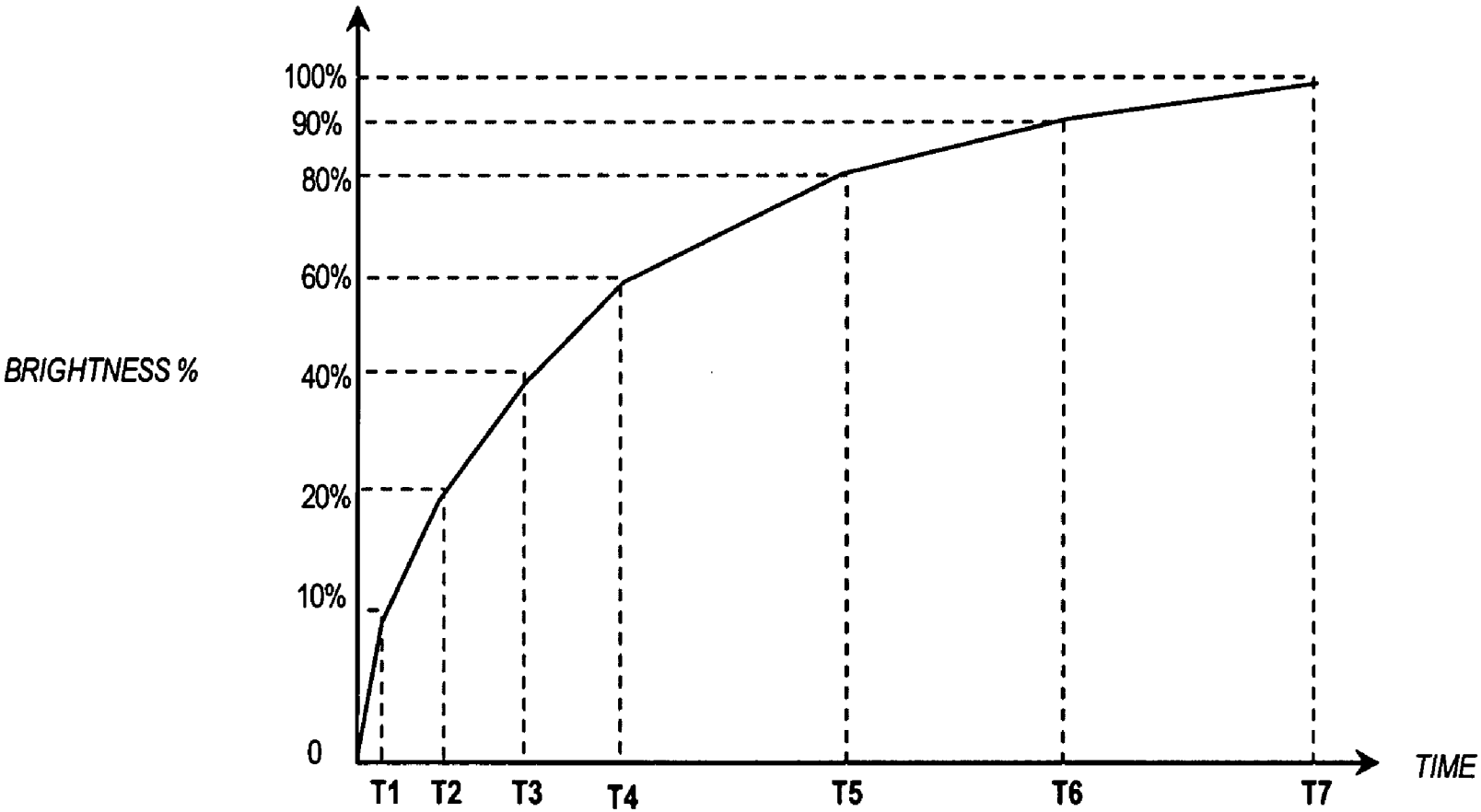
FIG. 9 is a graphical representation showing a curve representing backlight brightness vs. the time associated with changing between backlight brightness levels.

For one embodiment, an interpolation module 257 in the display driver 241 loads the parameters 271 stored as a result of characterizing backlight response, for example, and effectively models a response curve and approximate latency involved in transitioning between current and target backlight settings as shown in FIG. 9. While the curve of FIG. 9 shows backlight transitions from 0% to 100% to demonstrate the overall non-linearity of the curve, it will be appreciated that the interpolation module 257 may only effectively model a relevant portion of the curve.

For some embodiments, the delay count may be initiated from the time of the interrupt at the vertical blank, vertical sync or at another time including at a specific scanline, based on a timer, etc. The delay count may be specified in terms of a number of refreshes or frames (either integer or fractional number), a number of scanlines, in terms of fields, or any other manner.

Referring back to FIG. 6, if it is determined at decision block 610 that a dirty flag has not been set, then, at block 620, it is determined whether a post-processing flag has been set. If so, then a post-processing deferred procedure call (DPC) may be scheduled at block 625.

Figure 8:
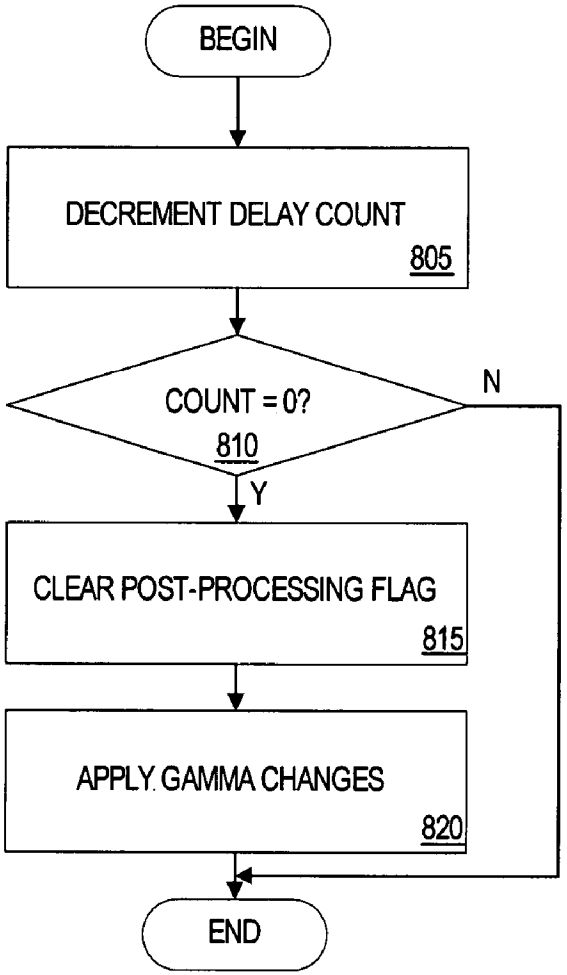
FIG. 8 is a flow diagram showing a method of one embodiment for a post-processing deferred procedure call that may be used to effect further display feature changes.

FIG. 8 is a flow diagram illustrating an exemplary post-processing DPC. At block 805, the delay count may be decremented and block 810, it is determined whether the count has reached 0. If not, the post-processing routine is exited may be revisited in response to a subsequent interrupt to determine whether changes to the gamma look-up table are to be applied at that time. If the count has reached 0, then at block 815, the post-processing flag is cleared and the gamma changes are applied. Using this approach, gamma changes and changes to the backlight may be applied at substantially the same time to avoid visually disturbing display artifacts that may be associated with applying these changes at different times.

Referring back to FIG. 6, at block 630, if no post-processing flag is set, the interrupt is disabled.

The exemplary approaches shown in FIGS. 5-8 represent illustrative approaches for interrupt processing that may be used, for example, where the operating system running on the host computing system may be, for example, a Windows NT operating system from Microsoft Corporation of Redmond, Wash. For other operating systems, a different approach may be used. For example, while deferred procedure calls are used in the example above, similar actions may be taken entirely within an interrupt service routine. Other approaches for performing similar actions are within the scope of various embodiments.

Thus, various embodiments of a method and apparatus for synchronizing backlight intensity changes with image luminance changes are described. In the foregoing specification, the invention has been described with reference to specific exemplary embodiments thereof. It will, however, be appreciated that various modifications and changes may be made thereto without departing from the broader spirit and scope of the invention as set forth in the appended claims. For example, while various embodiments describe using a gamma look-up table to control image luminance, other approaches for controlling image luminance are within the scope of various embodiments. For such embodiments, a different type of dirty flag may replace the gamma dirty flag and be set in a different manner responsive to hardware and/or software that affects image luminance. The specification and drawings are, accordingly, to be regarded in an illustrative rather than a restrictive sense.

What is claimed is:

1. A method comprising:

determining that a display-related event has occurred during a vertical frame period by determining whether an average image intensity has changed, whether a backlight setting has changed, and whether a gamma look-up table has changed;

setting a histogram dirty flag in response to detecting a change in average image intensity, setting a backlight dirty flag in response to a request to adjust a backlight setting, and setting a gamma dirty flag in response to a request to change a gamma look-up table;

in response to determining that the display-related event has occurred during a vertical frame period indicating that an associated change to at least one of a backlight intensity and an image luminance are to be undertaken, enabling an interrupt; and during subsequent interrupt processing, applying corresponding changes to the backlight intensity and the image luminance in a coordinated manner by initiating changes to the backlight intensity and, after a delay based on an amount of time it takes for the backlight intensity to reach a target level, applying changes to the image luminance.

2. The method of claim 1 wherein applying changes to the backlight intensity and the image luminance in a coordinated manner includes applying a backlight intensity change, and decrementing a delay counter based on a predetermined delay to determine when to apply a change to the image luminance.

3. The method of claim 1 wherein setting a histogram dirty flag in response to detecting the change in average image intensity includes setting the histogram dirty flag only if the detected change is larger than or equal to a predetermined trigger point.

4. A method comprising:

enabling an interrupt if one or more of an average image intensity, a backlight setting, or a gamma look-up table has changed during a vertical frame period;

setting a histogram dirty flag in response to detecting a change in average image intensity larger than or equal to a threshold change, setting a backlight dirty flag in response to receiving a request to change the backlight intensity, and setting a gamma dirty flag in response to receiving a request to change the image luminance; and in response to the interrupt, applying associated changes to a backlight intensity and an image luminance in a coordinated manner by initiating changes to the backlight intensity and, after a delay based on an amount of time it takes for the backlight intensity to reach a target level, applying changes to the image luminance.

5. The method of claim 4 further comprising receiving a request to change at least one of the backlight intensity and the image luminance from at least one of an input device, an operating system, a software module and an application program.

6. The method of claim 4 wherein detecting a change in average image intensity larger than or equal to a threshold change includes comparing an average image intensity of a current frame to an average image intensity of a previous frame.

7. The method of claim 6 further comprising computing a histogram for each frame, and determining an average image intensity for each frame based on the respective histogram.

8. The method of claim 4 wherein applying associated changes to the backlight intensity and the image luminance in a coordinated manner includes applying the change to the backlight intensity, and applying the change to the image luminance after a delay such that the change to the image luminance and the change to the backlight intensity take effect at substantially a same time.

9. The method of claim 8 further comprising initiating a delay count, and wherein applying the change to the image luminance occurs in response to completion of the delay count.

10. An article comprising a non-transitory computer-accessible medium storing a plurality of instructions that in response to being executed by a processor, cause the processor to:

determine that a display-related event has occurred during a vertical frame period by determining whether an average image intensity has changed, whether a backlight setting has changed, and whether a gamma look-up table has changed;

set a histogram dirty flag in response to detecting a change in average image intensity, set a backlight dirty flag in response to a request to adjust a backlight setting, and set a gamma dirty flag in response to a request to change a gamma look-up table;

in response to determining that the display-related event has occurred during a vertical frame period indicating that an associated change to at least one of a backlight intensity and an image luminance are to be undertaken, enable an interrupt; and during subsequent interrupt processing, apply corresponding changes to the backlight intensity and the image luminance in a coordinated manner by initiating changes to the backlight intensity and, after a delay based on an amount of time it takes for the backlight intensity to reach a target level, applying changes to the image luminance.

11. The article of claim 10 wherein applying changes to the backlight intensity and the image luminance in a coordinated manner includes applying a backlight intensity change, and decrementing a delay counter based on a predetermined delay to determine when to apply a change to the image luminance.

12. The article of claim 10, wherein setting a histogram dirty flag in response to detecting the change in average image intensity includes setting the histogram dirty flag only if the detected change is larger than or equal to a predetermined trigger point.

* * * * *

UNITED STATES PATENT AND TRADEMARK OFFICE

CERTIFICATE OF CORRECTION

PATENT NO. : 8,358,262 B2
APPLICATION NO. : 10/882446
DATED : January 22, 2013
INVENTOR(S) : Anil A. Degwekar et al.

It is certified that error appears in the above-identified patent and that said Letters Patent is hereby corrected as shown below:

In column 1, line 16, delete "Adjustment",filed" and insert -- Adjustment", filed --, therefor.

Signed and Sealed this
Nineteenth Day of March, 2013

Teresa Stanek Rea

Teresa Stanek Rea
*Acting Director of the United States Patent and Trademark Office*